United States Patent [19]

Iha

[11] Patent Number: 4,597,428

[45] Date of Patent: Jul. 1, 1986

[54] TWO DRUM CABLE DRIVE GARAGE DOOR OPENER

[75] Inventor: Kiyoshi Iha, Elk Grove Village, Ill.

[73] Assignee: Chamberlain Manufacturing Corporation, Elmhurst, Ill.

[21] Appl. No.: 575,864

[22] Filed: Feb. 1, 1984

[51] Int. Cl.[4] ..... E05F 15/00

[52] U.S. Cl. ..... 160/188; 160/193; 49/199; 49/49; 49/200

[58] Field of Search ..... 160/188, 193; 49/139, 49/199, 200, 188, 193

[56] References Cited

U.S. PATENT DOCUMENTS

| | | | |
|---|---|---|---|
| 1,796,660 | 3/1931 | Morse | 160/188 |
| 2,861,800 | 11/1958 | McKee et al. | 160/193 X |
| 2,909,718 | 10/1959 | Lawick | 160/193 X |
| 3,059,485 | 10/1962 | Bohlman et al. | 160/193 X |
| 3,439,727 | 4/1969 | Perl | 160/193 X |
| 3,481,074 | 12/1969 | Moss | 160/188 |
| 3,722,141 | 3/1973 | Miller | 160/188 |

*Primary Examiner*—Ramon S. Britts
*Assistant Examiner*—Cherney S. Lieberman
*Attorney, Agent, or Firm*—Hill, Van Santen, Steadman & Simpson

[57] ABSTRACT

A twin drum cable helical gear worm drive garage door opener which provides positive drive in either direction and ensures positive cable take-up and supply spool synchronization and ensures positive position relationship between the trolley and the operator head and has pre-assembled anchored cable ends which allow easy assembly and disassembly. The cable is oriented in the vertical plane which allows the point of cable latch to be in the same load/force plane and minimizes bowing of the support shaft under severe load conditions. The integral motor worm reels and support shaft results in a compact light weight unit and cable tensioning means are provided for allowing easy and simple adjustment of the unit when it is installed.

6 Claims, 10 Drawing Figures

TWO DRUM CABLE DRIVE GARAGE DOOR OPENER

CROSS-REFERENCES TO RELATED APPLICATIONS

Copending application entitled "Integral Device For Garage Openers" in which the inventor is Kiyoshi Iha assigned to the assignee of the present invention Ser. No. 428,340, filed Sept. 29, 1982, now U.S. Pat. No. 4,472,910, discloses a cable driven garage door operator wherein cables pass over pulleys connected to the floor such that a door can be pulled up or down by the cables.

BACKGROUND OF THE INVENTION

1. Field of the Invention

This invention relates in general to garage door operators and in particular to a novel unitary garage door operator which is very compact and a very reliable design and provides an integral motor, worm, reels and shaft and receiver arrangement which can be quickly and easily installed.

2. Description of the Prior Art

Garage door operators are known wherein the trolley for the garage door operator is driven by a worm that mates with the trolley. Other garage door operators are known which are chain driven by an endless chain which is driven by a suitable motor.

SUMMARY OF THE INVENTION

The present invention relates to a novel worm drive with a cable and twin drums and helical gears which provide positive drive in either direction and ensures positive cable take-up and supply spool synchronization. Positive position relationship is ensured between the trolley and the operator head and the ends of the cable are pre-assembled and anchored to the drive reels which allows easy assembly and disassembly. The cable is oriented in the vertical plane which allows the point of cable latch to be in the same load/force plane and effectively minimizes the rail bowing under severe load conditions. The tubular rail can be broken into disassembled parts and can be easily and quickly reassembled for installation and a novel tension adjustment for the cables assures that the tension of the cable can be quickly and easily adjusted during installation. The up and down limits can be easily adjusted and the up and down force adjustments can be accurately and easily adjusted and merely require the setting of potentiometers which provides a positive and accurate way of adjusting the up and down force limits.

Since the cable is attached at the factory to the cable drums, the unit can be quickly assembled and installed to operate a garage door, for example.

Other objects, features and advantages of the invention will be readily apparent from the following description of certain preferred embodiments thereof taken in conjunction with the accompanying drawings although variations and modifications may be effected without departing from the spirit and scope of the novel concepts of the disclosure and in which:

DESCRIPTION OF THE PREFERRED EMBODIMENTS

Figure 1:
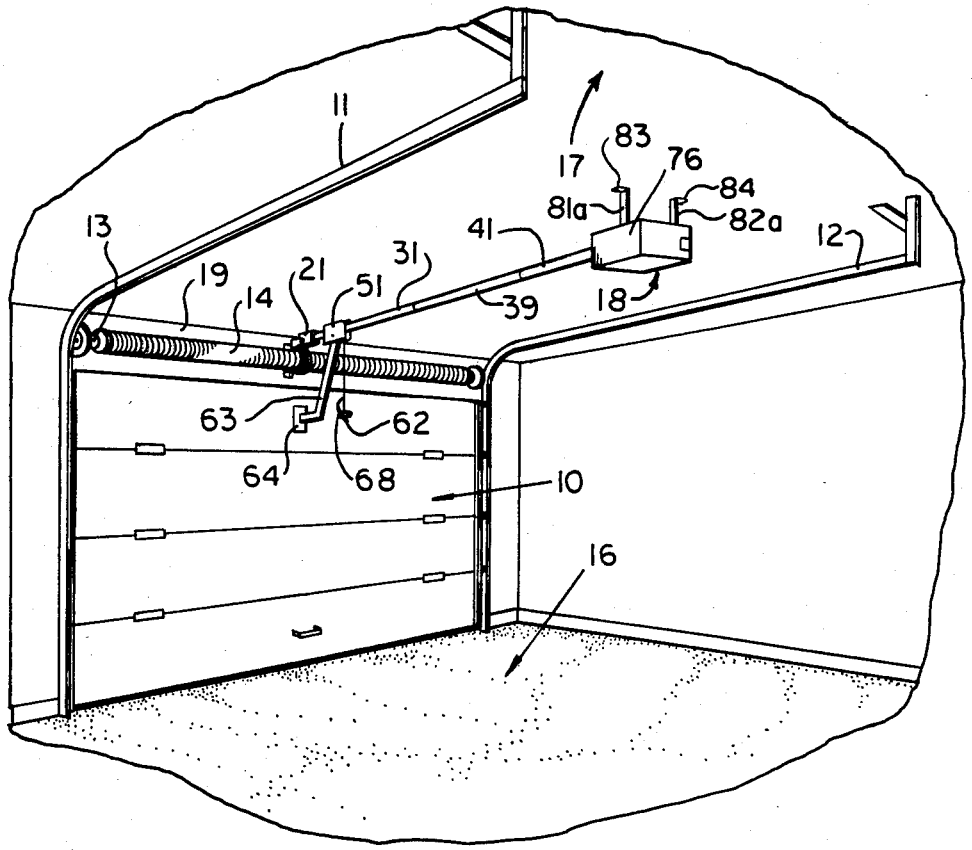
FIG. 1 illustrates the garage door operator of the invention installed to operate a door.

FIG. 1 illustrates the garage door operator 18 of the invention mounted on the ceiling 17 of a grage, for example. A garage door 10 is movable on rails 11 and 12 from an opened to closed positions. A shaft 13 is rotatably mounted on the wall 19 above the door 10 and has a counter-balance spring 14. Suitable cables and pulleys are associated with the end of the shaft 13 and the door so as to bias the door to the down position toward the floor 16 and upwardly toward the ceiling 17 in a conventional manner The garage door operator 18 is attached with a bracket 21 to the head wall 19 and has an arm 63 which is connected by bracket 64 to the door 10. The upper end of the arm 63 is connected to a trolley which rides on the rail of the garage door operator 18. A release rope 62 has a handle 68 so as to release the trolley from the actuating cable of the garage door operator so that the door can be manually opened or closed. Hangar member 81*a* and 82*a* are attached to the ceiling 17 by holding means such as screws 83 and 84 which support the cover member 76 which includes the motor and actuating mechanism of the garage door operator.

Figures 3, 6, 7:
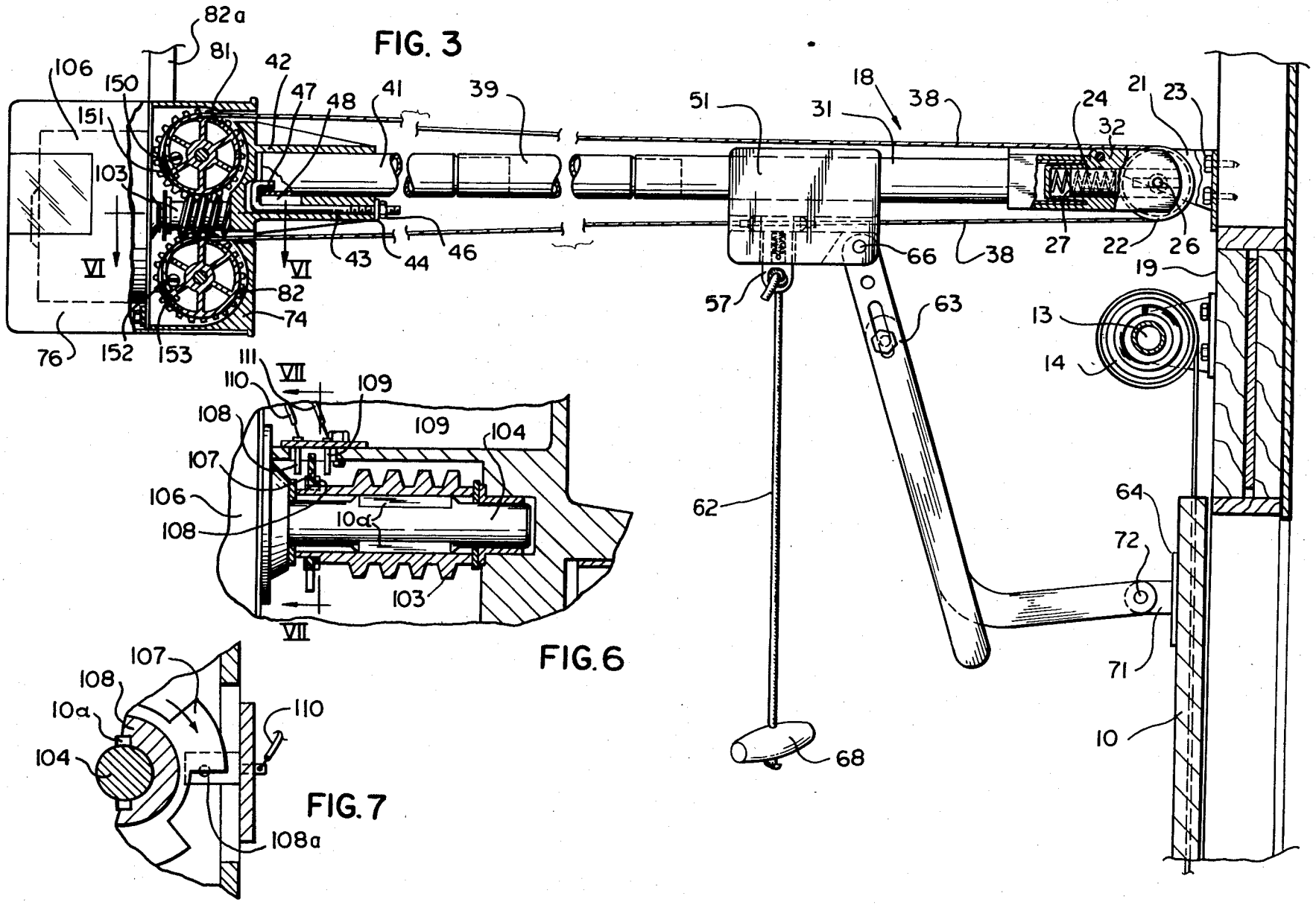
FIG. 3 is a side partially sectional view illustrating the invention.
FIG. 6 is a sectional view taken on line VI—VI from FIG. 3.
FIG. 7 is a cut-away sectional view taken from line VII–VII in FIG. 6.
Figure 5:
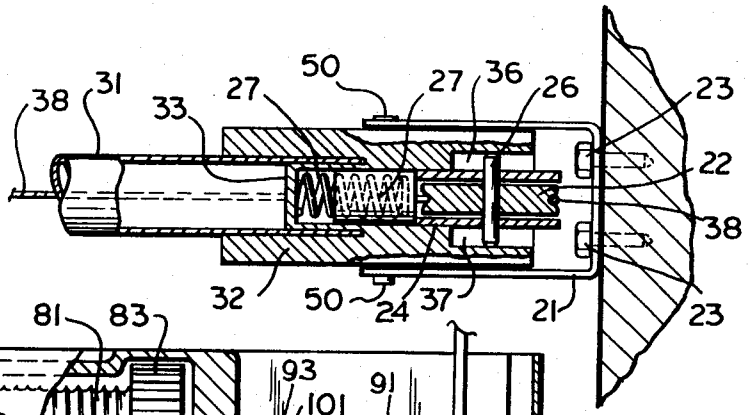
FIG. 5 illustrates the end supporting bracket of the invention in sectional view.
Figure 8:
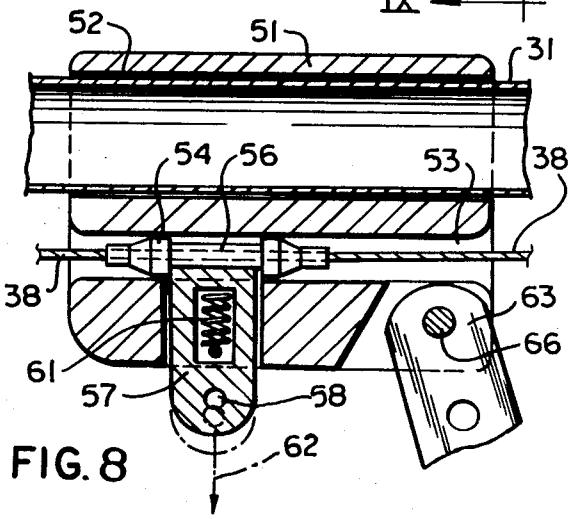
FIG. 8 is a sectional view through the trolley.

As illustrated in FIGS. 3 through 9, within the cover member 76 is mounted a frame member 74 which carries a truncated conical member 42 in which a first section 41 of a support tube is received which serves as a rail to carry the trolley 51. A second section 39 fits over the right end relative to FIG. 3 of the section 41 and a third section 31 has a left end which fits over a reduced cross-sectional portion of tube 39. As best shown in FIGS. 3 and 5, a slidable bracket 32 is received over the right end relative to FIGS. 3 and 5 of the tubular section 31 and carries a pulley 22 which is supported on a shaft 26 which extends through a movable plunger 24 which is spring biased by a spring 27 to the right relative to FIGS. 3 and 5. Slots 36 and 37 allow ends of the shaft 26 to move relative to the member 32. The bracket 21 is connected by bolts 50 to the member 32 and to the head wall 19 by lag screws 23. The cable 38 passes over the pulley 22 as shown in FIG. 3. The pulley 22 lies in the vertical plane and the lower portion of the cable 38 carries the trolley 51 as shown in FIGS. 3 and 8. The trolley 51 is formed with an opening 52 through which the tube sections 31, 39 and 41 can pass. A second opening 53 receives the cable 38 therethrough which is attached to an adapter 54 formed with a notch 56 into which a pawl 57 is received. The pawl 57 is slidably received in an opening of the trolley 51 as shown in FIG. 8 and engages the notch 56 in the member 54 when the trolley is locked to the cable 38. A spring 61 biases the pawl 57 into the notch 56 as shown.

An opening 58 in the pawl 57 receives one end of a rope 62 which has a handle 68 on its lower end as illustrated in FIG. 3 so as to release the pawl 57 so that the trolley 51 can move relative to the cable 38. The garage door actuating arm 63 is pivoted to the trolley 51 by a pivot pin 66 as illustrated.

Figure 9:
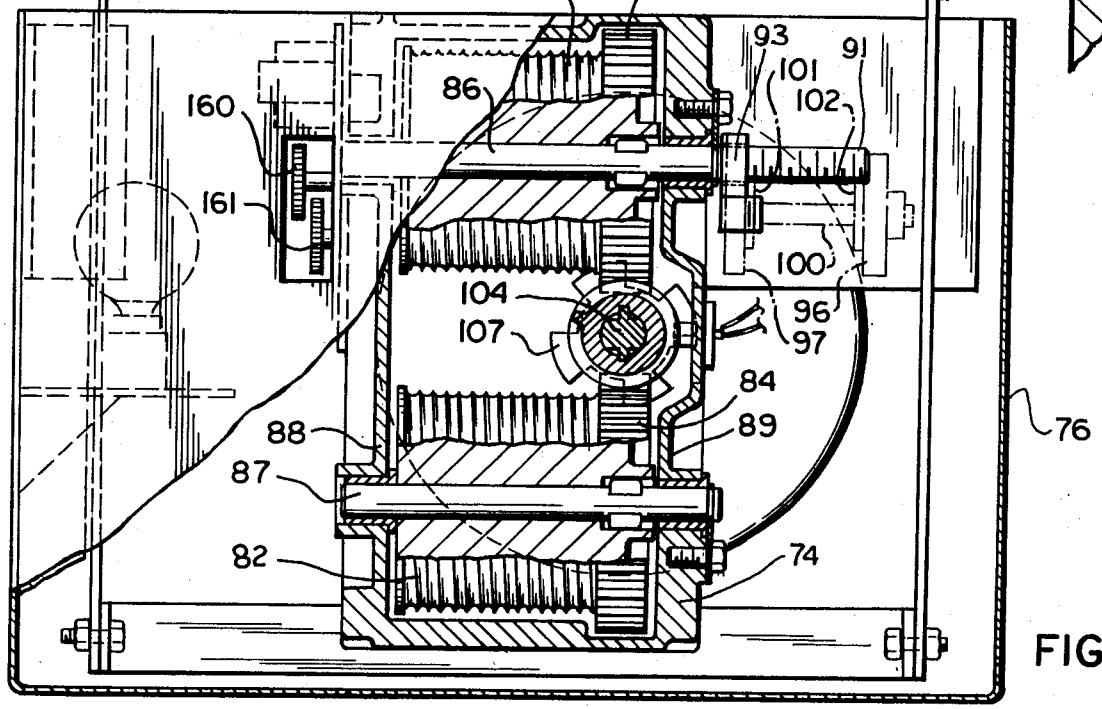
FIG. 9 is a cut-away sectional view through the cable drums.
Figure 4:
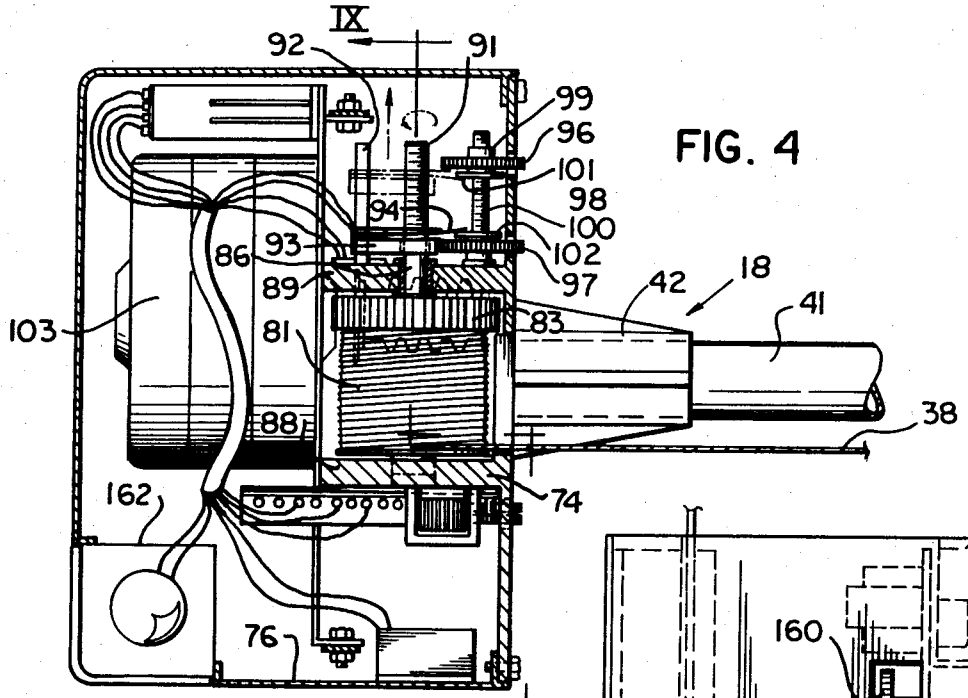
FIG. 4 is a sectional view illustrating the invention.

The portion of the cable 38 which passes over the top of the pulley 22 is attached to a reel 81 illustrated in FIGS. 3, 4, and 9. The lower portion of the cable 38 is attached to a reel 82. The reel 81 is rotatably supported in the frame 74 by a shaft 86 which has an extending portion 91 that is threaded and which threadedly receives an up-down limit switch 93. The switch and carrier 93 is formed with a second opening through which a guide shaft 92 extends so as to prevent the switch carrier 93 from rotating so that it moves along shaft 91 as the shaft 91 rotates. A threaded shaft 100 is mounted on frame 74 and a pair of up and down limit switch threaded members 101 and 102 can be manually rotated by thumb screws 96 and 97 on the shaft 100 so as to set the up and down limit positions. The switch contacts of the up and down limit switch member 93 engage the members 101 and 102 so as to actuate both the up and down limit switches, respectively.

The reel 82 is rotatably supported in the frame member 74 on a shaft 87. The reel 81 has a gear 83 mounted on one end and the gear 82 has a gear 84 mounted on one end. A worm 103 meshes with the gears 83 and 84 so as to turn the reels 81 and 82 simultaneously and in the opposite directions so as to drive the cable 38 and the garage door trolley 51. The worm 103 has a hub 108 through which the shaft 104 of motor 106 extends. The shaft 104 is connectd to the hub 108 and worm 103 by a suitable keys 10*a*. The hub 108 carries a shutter member 107 which has alternating portions of larger and smaller diameters. An infrared detector 108*a* is mounted on one side of the shutter 107 and an infrared light source 109 is mounted on the other side of the shutter. As the shaft 104 rotates, the shutter 107 causes pulses of light to be revceived at the infrared detector 108*a*. The input electrical lead 111 is connected to the infrared source 109 and an output lead 110 is connected to the infrared detector 108*a*.

The upper portion of the cable 38 has its end 150 attached to the upper reel 81 by a clamping means 151 and the lower end 152 of cable 38 is attacted to the lower reel 82 by a clamp 153. Since the ends of the cable 38 are rigidly clamped to reels 81 and 82, the length of the cable 38 between the reels 81 and 82 remains constant so when one reel is paying out cable the other reel will be taking up cable. It is to be realized, of course, that the length of the cable is such that the cable can move so as to move the trolley 51 from a first position where the door engages the floor 16 to a second position wherein the door is in the full-up position. The length of cable 38 and attachment of the ends of the cable 150 and 152 to the reels 81 and 82 may be done at the factory before the unit is shipped. A J-bolt 43 is mounted in the conical portion 42 of the frame member 74 and has a hook 47 which engages the left end relative to FIG. 3 of the tube 41. The J-bolt 43 has a threaded portion upon which a nut 46 is received so as to adjust the hook portion 47 relative to the reference 44 of the member 42 so as to allow the rail comprising the tubes 31, 39 and 41 to be moved to the right or left relative to FIG. 3 so as to adjust the tension in the cable 38. Thus, as the nut 46 is tightened to move the J-bolt 43 to the right relative to FIG. 3, the hook 47 will move the rail to the right thus moving the pulley 22 to the right relative to FIG. 3 thus tightening the cable 38.

A down force adjustment 160 and an up force adjustment 161 are connected to the control unit of the garage door operator. A light 162 is provided to provide illumination in the garage during the operation of the garage door operator and for a fixed time thereafter.

Figure 2:
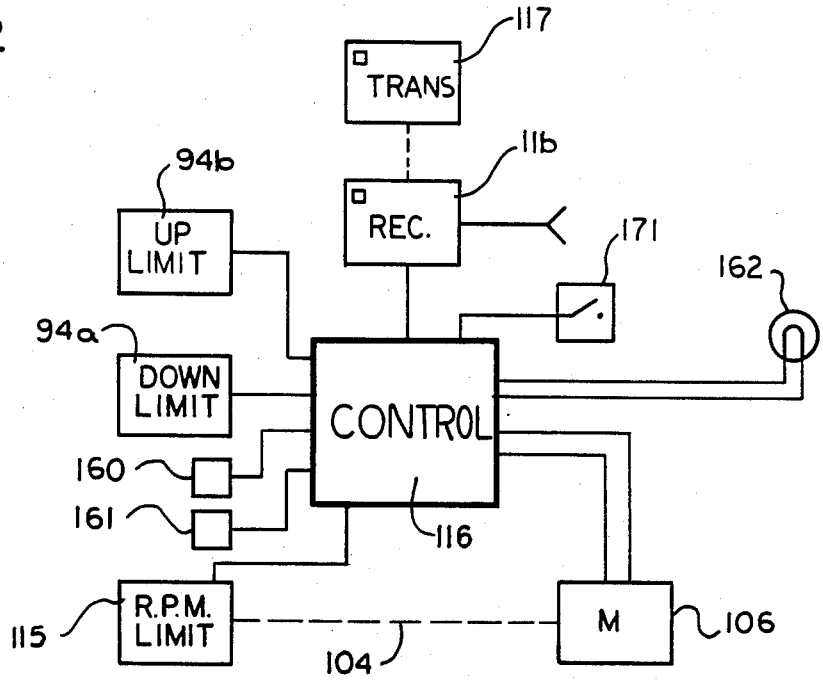
FIG. 2 is a block diagram illustrating the transmitter, receiver and control circuit of the invention.

FIG. 2 is a block diagram illustrating a receiver 11*b* which can be energized by a transmitter 117 to actuate the garage door control unit 116. A manual switch 171 is also connected to the control 116 for actuating the unit. The motor 106 is controlled by the control unit 116 and the output shaft 104 drives the RPM limit mechanism 115. The up limit switch 96b is connected to the control 116 as is the down limit switch 94*a*. The up and down limit force adjustments 160 and 161 are also connected to the control 116.

Figure 10:
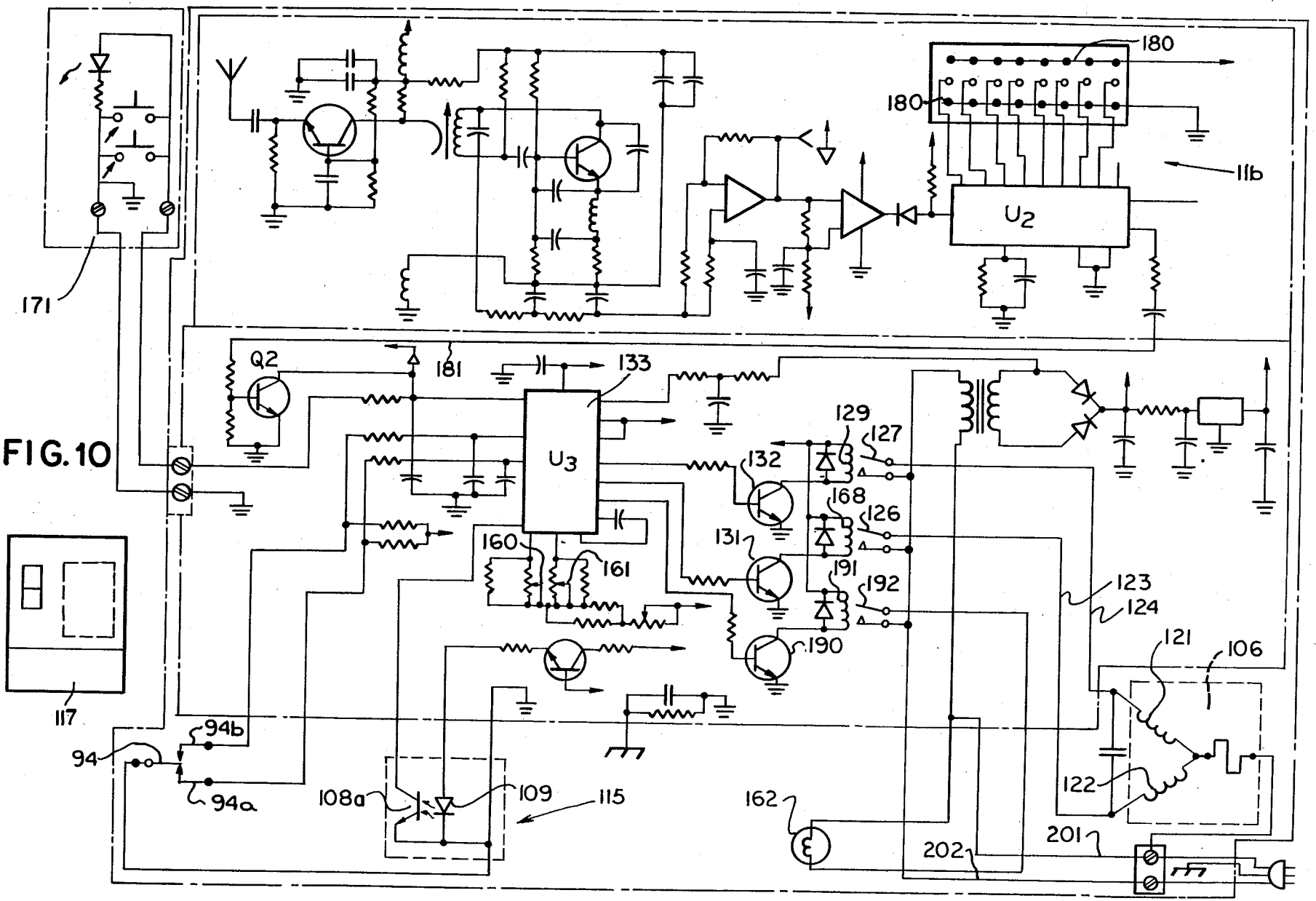
FIG. 10 is an electrical schematic of the receiver and control unit of the invention.

FIG. 10 is an electrical schematic of the garage door operator and the receiver 11*b* has a code select switch 180 which can be selectively set to different codes. The transmitter 117 also has code selecting switch which must be set to the same combination as the receiver selection switches 180. The receiver supplies an output on lead 181 through a transistor Q2 to an integrated circuit 133 when the garage door operator is to be energized. Command switch 171 also supplies an input to the integrated circuit 133 when the garage door is to be manually actuated. The down limit switch 94*b* supplies input to the integrated circuit 133 when the down limit is reached. The up limit switch 94*a* supplies an input to the integrated circuit 133 when the up limit is reached. The RPM detecting means 115 including the infrared source 109 and the detector 108*a* supply an input to the input integrated circuit 133 as shown. The integrated circuit supplies an output through a transistor 132 to a relay 129 which actuates a switch 127 which causes the motor 106 to run in a direction so as to raise the garage door. During this operation, a winding 121 of the motor 106 is energized. A second output of the integrated circuit 133 supplies an output through transistor 131 to a relay 168 to close switch 126 which causes the motor to run in a direction so as to close the door. During this operation, a winding 122 of the motor is energized. A transistor 190 receives an output from the integrated circuit 133 to energize relay 191 to close switch contacts 192 so as to turn on the light 162 when the garage door operator is energized.

To install the garage door operator of the invention, the member 32 is placed over the end of tube 31 and tubes 31, 39 and 41 are assembled and passed through the trolley 51 and into the opening of member 42. The nut 46 of the J-bolt 43 is tightened until the cable 38 is properly tensioned. Then the bracket 21 is connected to the head wall 19 by the lag screws 23 and the other end of the unit is connected by the support arms 81*a* and 82*a* and the bolts 83 and 84 to the ceiling 17 of the garage. Then the arm 63 is attached by bracket 71 to the door 10 and power is applied to the power leads 201 and 202. The control switch 171 is energized to move the door 10 to the opened position and the up limit position is adjusted by moving the member 101 on the shaft 100 so that the door stops at the proper up position. Then the operator is energized again by closing switch 171 and the down limit member 102 is adjusted on shaft 100 so that the door stops at the proper down position. The up force and down force is adjusted by adjusting the knobs 160 and 161 which are connected to suitable potentiometers illustrated in the electrical schematic in FIG. 10 which supply inputs to the integrated circuit 133 so as to adjust these forces.

It is seen that the present invention provides a compact and simple to install garage door operators which can be easily adjusted by the installed and which is light and compact.

Although the invention has been described with respect to preferred embodiments, it is not to be so limited as changes and modifications can be made which are within the full intended scope of the invention as defined by the appended claims.

I claim as my invention:

1. A garage door operator comprising, a pulley bracket adapted to be attached to a wall above a garage door, a pulley rotatably supported by said bracket, a motor and control unit, a tubular rail adjustably receivable in said pulley bracket and said motor and control unit, a cable, a first reel rotatably mounted in said motor and control unit and one end of said cable attached to said first reel, a second reel rotatably mounted in said motor and control unit and the second end of said cable attached to said second reel, said cable passing from said first reel over said pulley and to said second reel, a motor mounted in said motor and control unit coupled to simultaneously drive said first and second reels in opposite directions, and a trolley attached to said cable and connected to the garage door to move it between opened and closed positions, wherein bearings rotatably supported by said pulley in said bracket and said bearings are mounted so that they can move relative to said bracket, and spring means for spring biasing said berings and said pulley away from said motor and control unit and including an adjustment means in said motor and control unit so as to move the end of said rail relative to said motor and control unit to tighten said cable.

2. A garage door operator according to claim 1 wherein said adjustment means comprises a bolt attached to said rail, and means attached to said motor and control unit threadedly engaged with said bolt to adjust said rail.

3. A garage door operator according to claim 2 wherein said bolt is a J-bolt.

4. A garage door operator according to claim 1 wherein said tubular rail comprises a plurality of interconnecting tubular portions.

5. A garage door operator according to claim 1 including a worm connected to the output shaft of said motor, a first gear engageable with said worm and connected to said first reel and a second gear engageable with said worm and connected to said second reel.

6. A garage door operator according to claim 5 including up and down limit switches operable by said motor to turn it off at the up and down limits.

* * * * *

UNITED STATES PATENT AND TRADEMARK OFFICE

CERTIFICATE OF CORRECTION

PATENT NO. : 4,597,428

DATED : July 1, 1986

INVENTOR(S) : Kiyoshi Iha

It is certified that error appears in the above—identified patent and that said Letters Patent is hereby corrected as shown below:

Column 2, line 10, "FIG. 9" should start a new paragraph

Column 2, line 20, change "grage" to --garage--

Column 2, line 27, add a period after "manner"

Column 3, line 33, change "connectd" to --connected--

Column 3, line 40 change "revceived" to --received--

Signed and Sealed this

Thirtieth Day of December, 1986

*Attest:*

DONALD J. QUIGG

*Attesting Officer*

*Commissioner of Patents and Trademarks*